US007722439B2

(12) United States Patent
Torii

(10) Patent No.: US 7,722,439 B2
(45) Date of Patent: May 25, 2010

(54) SEMICONDUCTOR DEVICE MANUFACTURING APPARATUS AND METHOD

(75) Inventor: Koji Torii, Chuo-ku (JP)

(73) Assignee: Elpida Memory, Inc., Tokyo (JP)

( * ) Notice: Subject to any disclaimer, the term of this patent is extended or adjusted under 35 U.S.C. 154(b) by 26 days.

(21) Appl. No.: 11/950,496

(22) Filed: Dec. 5, 2007

(65) Prior Publication Data

US 2008/0146123 A1 Jun. 19, 2008

(30) Foreign Application Priority Data

Dec. 18, 2006 (JP) ..... 2006-339904

(51) Int. Cl.
*B24B 7/22* (2006.01)

(52) U.S. Cl. ..... 451/41; 451/398; 451/288

(58) Field of Classification Search ..... 451/60, 451/398, 388, 288, 41
See application file for complete search history.

(56) References Cited

U.S. PATENT DOCUMENTS 5,679,065 A * 10/1997 Henderson ..... 451/290
6,224,472 B1 * 5/2001 Lai et al. ..... 451/398
6,354,927 B1 * 3/2002 Natalicio ..... 451/287
6,471,566 B1 * 10/2002 Mikhaylich et al. ..... 451/41
7,044,838 B2 * 5/2006 Maloney et al. ..... 451/41

FOREIGN PATENT DOCUMENTS

| | | | |
|---|---|---|---|
| JP | 11-333712 | A | 12/1999 |
| JP | 2002-124492 | A | 4/2002 |
| JP | 2002-539620 | A | 11/2002 |
| JP | 2003-103456 | A | 4/2003 |
| JP | 2003-236743 | A | 8/2003 |
| JP | 2004-342830 | A | 12/2004 |
| WO | 2005/058545 | A1 | 6/2005 |

* cited by examiner

*Primary Examiner*—Robert Rose
(74) *Attorney, Agent, or Firm*—Sughrue Mion, PLLC

(57) ABSTRACT

A semiconductor device manufacturing apparatus according to the present invention comprises a head for holding a semiconductor wafer, a retainer ring for surrounding the outer periphery of the semiconductor wafer held by the head, and a polishing pad for polishing a polished surface of the semiconductor wafer. This apparatus presses the polished surface of the semiconductor wafer against the polishing pad together with the retainer ring to polish the semiconductor wafer. The retainer ring used in the present invention has a surface that is in contact with the polishing pad, which increases a contact area of the retainer ring against the polishing pad in accordance with wear of the retainer ring.

6 Claims, 6 Drawing Sheets

SEMICONDUCTOR DEVICE MANUFACTURING APPARATUS AND METHOD

This application is based upon and claims the benefit of priority from Japanese patent application No. 2006-339904, filed on Dec. 18, 2006, the disclosure of which is incorporated herein in its entirety by reference.

BACKGROUND OF THE INVENTION

1. Field of the Invention

The present invention relates to a semiconductor device manufacturing apparatus and method. More particularly, the present invention relates to a retainer ring provided in a CMP (Chemical Mechanical Polishing) apparatus for polishing a semiconductor wafer, and a method of manufacturing a semiconductor device using the CMP apparatus.

2. Description of the Related Art

An increasingly strict level of flatness has been required for the surface of semiconductor devices for patterning thereon in semiconductor device manufacturing steps as wires become finer and finer. Then, after the design rule of semiconductor devices was reduced to less than 0.35 μm, CMP apparatuses are generally used to directly polish the surface of semiconductor devices.

This CMP apparatus can improve the uniformity and planarity of the surface of a micromachined semiconductor device, and is particularly effective for eliminating steps on the surface of the semiconductor device.

FIG. 1 generally shows a head section of a CMP apparatus related to the present invention.

Head 3 of the CMP device is a main component for pressing semiconductor wafer 5 against polishing pad 8 to perform a polishing action. Head 3 comprises a resin-made retainer ring 1 for holding semiconductor wafer 5 which is being polished by head 3. This ring has not only a function of guiding semiconductor wafer 5 subjected to the polishing but also a function of adjusting a polishing profile near the edge of the semiconductor wafer.

FIG. 2 schematically shows the action of retainer ring 1 during a polishing operation. During polishing, a certain pressure acts on the back surface of semiconductor wafer 5 from head 3 through rubber-made membranes 6*a*, 6*b*, 6*c*. In this event, it is ideal that the entire surface of semiconductor wafer 5 is uniformly pressed against the surface of polishing pad 8, but the applied pressure is made non-uniform in a region within several millimeters from the edge of semiconductor wafer 5 due to the influence of the counter-action of the downward deformation of polishing pad 8. For this reason, retainer ring 1 is provided in a shape which surrounds the outer periphery of semiconductor wafer 5. In this way, the region non-uniformly applied with the applied pressure is shifted from the bottom surface of semiconductor wafer 5 to the bottom surface of retainer ring 1, thereby uniformly applying the pressure within the wafer surface. Also, by changing the pressure to polishing pad 8 of retainer ring 1, the profile of polishing rate can also be changed around the outer periphery of semiconductor wafer 5.

Generally, retainer ring 1 has a flat surface which comes into contact with polishing pad 8. In addition, in order to promote a polishing material supplied to semiconductor wafer 5 and facilitate head 3 to dechuck from polishing pad 8, a groove is formed at a certain depth in some cases (for example, see Japanese laid-open patent publication No. 11-333712, Japanese laid-open patent publication No. 2002-124492 and the like).

Describing the polishing operation of the CMP apparatus, after semiconductor wafer 5 is fixed with membranes 6*a*, 6*b*, 6*c* of head 3, semiconductor wafer 5 is moved above polishing pad 8, and retainer ring 1 is brought into contact with polishing pad 8 by using a predetermined pressure. Subsequently, semiconductor wafer 5 is pressed against the surface of polishing pad 8 with an air pressure through membranes 6*a*, 6*b*, 6*c*. In these circumstances, polishing pad 8 is being applied with a rotating motion about the center thereof, and a polishing material is being supplied at the same time. The surface of the wafer is polished in this basic operation.

When the surface of such a wafer is polished, retainer ring 1 made of a resin is increasingly worn. The resin material most typically used for retainer ring 1 is PPS (polyphenylene sulfide), and retainer ring 1 made of PPS is worn down by approximately 0.1 mm to 0.5 mm after 1000 wafers are polished. In this regard, retainer ring 1 is replaced when the groove in the contact surface reaches a predetermined wear amount (approximately 1.5 mm) within a remaining range. Otherwise, a PEEK (polyether ether ketone) resin, a PET resin and the like are used as well as the above resins. With the PEEK resin, a wear amount is generally kept smaller than the PPS resin.

In the polishing apparatus as described above, as the surfaces of wafers are repeatedly polished, retainer ring 1 made of a resin is locally worn down more, resulting in a change in the shape of a surface of retainer ring 1 that is in contact with the polishing pad. In particular, the shape is changed near the outer periphery of retainer ring 1. As a result, the effective pressure of retainer ring 1 (contact pressure with polishing pad 8) increases, causing a change in the polishing rate near the edge of semiconductor wafer 5, and causing non uniform polishing of the wafer surface to be exacerbated.

As countermeasures to this, at present, the pressure of retainer ring 1 to polishing pad 8 is sequentially reduced in accordance with the degree to which retainer ring 1 is worn down. However, while the exacerbation of uniformity can be restrained to some degree, this action requires continuous condition adjustments and significantly hampers productivity.

Also, while more frequent replacements of retainer ring 1 is also taken into consideration, this is not a realistic solution. The reason is described with reference to FIG. 3. The graph of FIG. 3 shows the correlation of within-wafer uniformity of wafer polishing to the wear amount of retainer ring 1 when no adjustment is made to the pressure of retainer ring 1 toward polishing pad 8. The vertical axis of the graph indicates that a lower value represents higher (better) uniformity. What is noted in this graph is that the within-wafer uniformity largely changes (exacerbates) at an initial stage of retainer ring wear, such as a wear amount of 0 to 0.5 mm. This is because the shape on the outer peripheral side of retainer ring 1 largely changes at an initial stage of wear to increase the effective pressure. Since aging changes in within-wafer uniformity become obvious at the initial stage after the start of use, it can be said that the action involving a replacement of retainer ring 1 at an earlier stage cannot solve the aforementioned problem.

A further investigation was made on the use of a material exhibiting a low wear rate for members which form the parts of retainer ring 1. However, this action simply causes an initial wear stage, in which the within-wafer uniformity changes in large as shown in FIG. 3 and which continues for a longer period, and does not constitute an effective solution.

SUMMARY OF THE INVENTION

It is an object of the present invention to solve the aforementioned problems. One object of the invention is to provide a retainer ring structure which is capable of stabilizing the uniformity of the amount of polishing in the surface of a wafer even if a retainer ring is worn.

A semiconductor device manufacturing apparatus according to one aspect of the present invention comprises a head for holding a semiconductor wafer, a retainer ring for surrounding the outer periphery of the semiconductor wafer held by the head, and a polishing pad for polishing a polished surface of the semiconductor wafer. This apparatus presses the polished surface of the semiconductor wafer against the polishing pad together with the retainer ring to polish the semiconductor wafer. In this polishing apparatus, the aforementioned problem is solved by forming a shape in the surface of the retainer ring in contact with the polishing pad, which increases the contact area of the retainer ring with the polishing pad in accordance with the wear of the retainer ring.

In this regard, while Japanese laid-open patent publication No. 11-333712 (hereinafter called "Patent Document 1") and Japanese laid-open patent publication No. 2002-124492 (hereinafter called "Patent Document 2") also disclose structures of retainer rings for CMP apparatus, it can be said that the aforementioned problem cannot be solved by the contents disclosed therein. In the following, reasons therefor will be described.

The invention disclosed in Patent Document 1 forms a groove in a retainer ring to limit the influence of heat generation in polishing, which has been confirmed to be caused by heat generation that is associated with an increase in the width of the retainer ring. Patent Document 1 describes that such a groove improves limiting the influence of heat generation caused by friction and improves the efficiency of the supply and exhaustion of polishing material.

It can be said that the reduction of a contact resistance by forming the groove in order to limit heat generation is not intended to eliminate the groove, and from the fact that there is no reference to the depth of the groove, Patent document 1 is different from the configuration of the present invention and therefore cannot achieve the object of the present invention.

The invention disclosed in Patent Document 2 improves the efficiency of supplying polishing material by forming a groove in a retainer ring and supplying polishing material from the inside of the groove. Patent Document 2 describes in Paragraph [0048] that an inclination is formed in the groove for supplying the polishing material to ensure a pressing area on the inner periphery of the retainer ring.

The groove is formed with an inclination, but if the groove for supplying a polishing material is gradually eliminated, the polishing material supply efficiency becomes lower, so that it is apparent that the invention described in this document fails to accomplish improvements in the polishing material supply efficiency, which is the object of the invention. Accordingly, Patent Document 2 differs from the present invention in object and configuration.

As described above, while two known documents related to the present invention are presented by way of example, they are unable to produce the results which the object of the present invention is designed to achieve. Taking into consideration the limitations of both inventions described in the two patent documents, the present invention provides a unique configuration for efficiently producing definite effects.

The above and other objects, features and advantages of the present invention will become apparent from the following description with reference to the accompanying drawings which illustrate examples of the present invention.

DESCRIPTION OF THE EXEMPLARY EMBODIMENT

Figure 1:
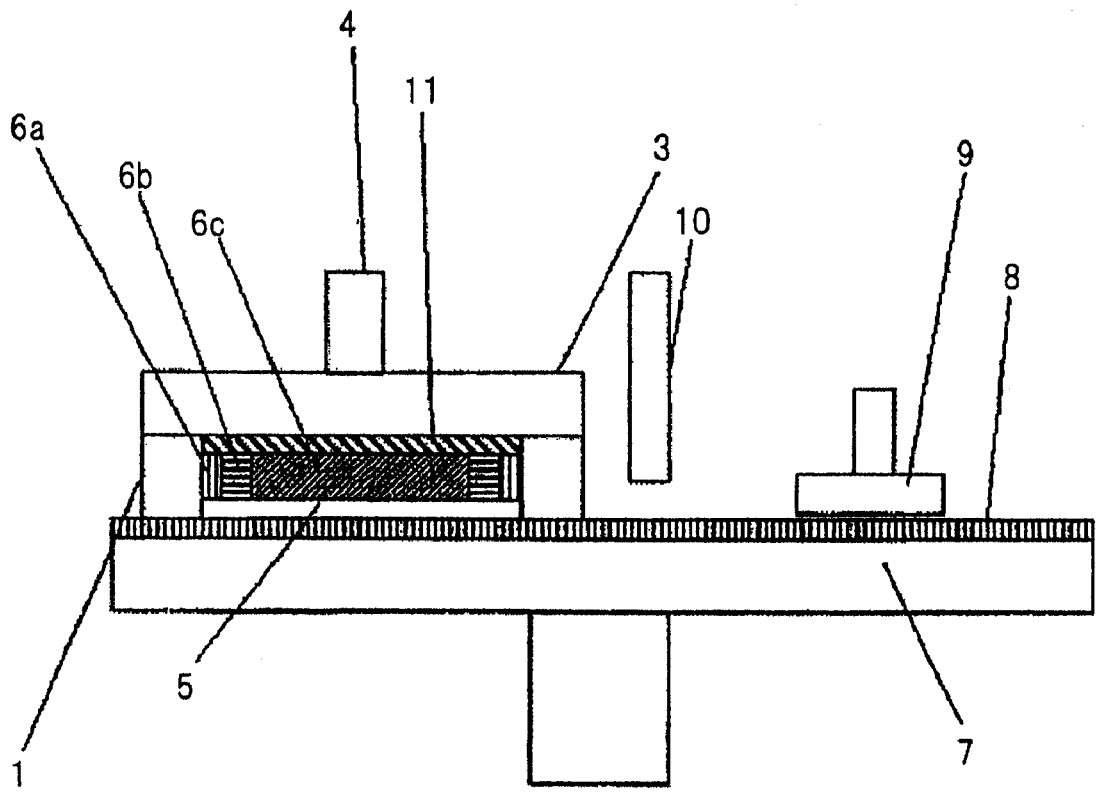
FIG. 1 is a diagram generally showing a head section of a CMP apparatus related to the present invention.
Figure 2:
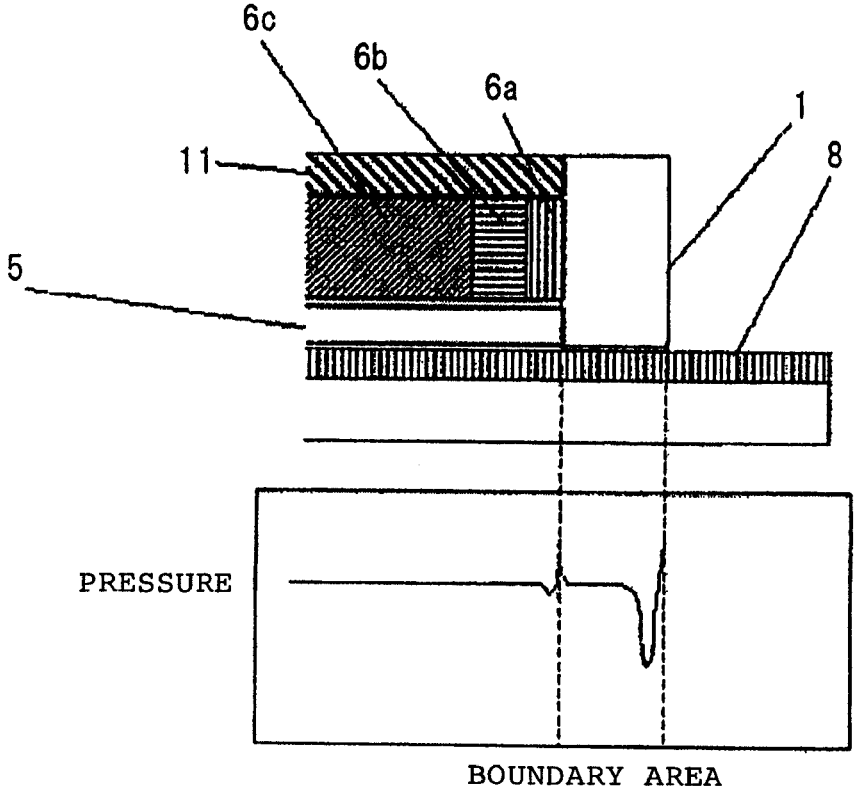
FIG. 2 is a schematic diagram of the action on a retainer ring during a polishing operation of the CMP apparatus of FIG. 1.

In the following description, the same components as those in the background art shown in FIG. 1 are designated the same reference numerals.

First Exemplary Embodiment

Figure 4:
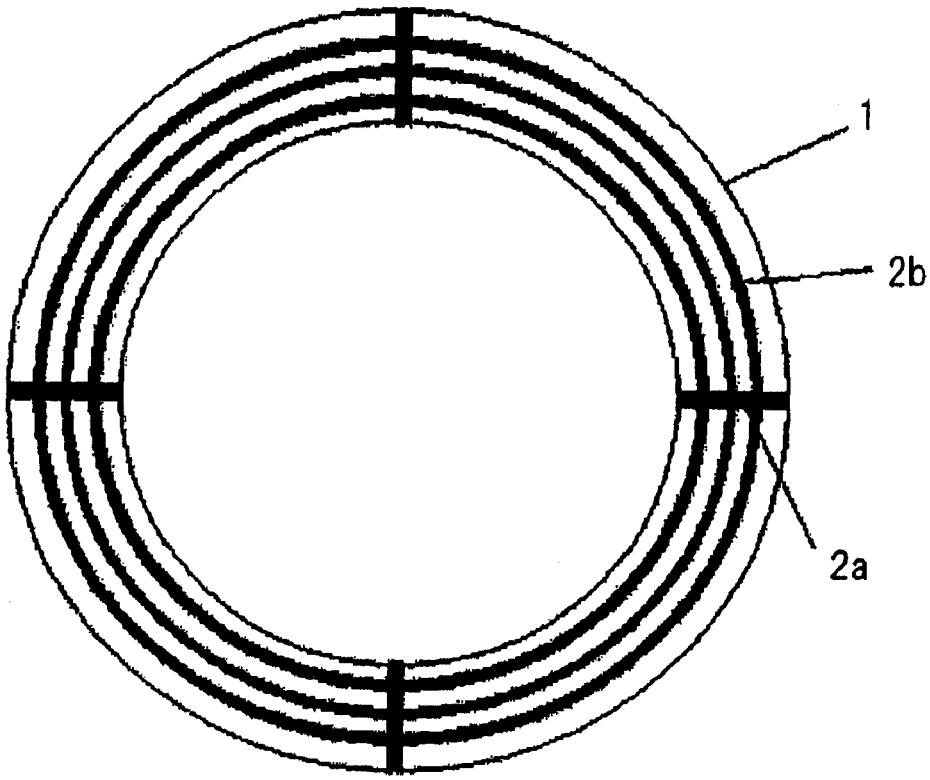
FIG. 4 is a plan view seen from a surface which comes into contact with a polishing pad of a retainer ring used in a first exemplary embodiment of the present invention.

FIG. 4 is a plan view seen from a surface of a retainer ring which comes into contact with a polishing pad, used in a first exemplary embodiment of the present invention. Grooves 2*a*, 2*b* are formed in a surface of retainer ring 1 which comes into contact with polishing pad 8.

As previously shown in FIG. 1, such retainer ring 1 is mounted to head 3 which is the main component of a CMP apparatus. Spindle 4 is provided above head 3 for applying a rotating motion to head 3. Membrane 6 is also mounted to head 3, in addition to retainer ring 1, for chucking semiconductor wafer 5 and for applying a pressure on the back surface of semiconductor wafer 5 during polishing. Membrane 6 is divided into several regions, such that different pressures can be applied by membrane 6*a* to the outermost region of the wafer, to membrane 6*b* for a region inside of membrane 6*a*, and to membrane 6*c* for a wide region of the wafer except for the outer peripheral side. In this way, the surface of semiconductor wafer 5 can be pressed against the surface of polishing pad 8 with an equally distributed load.

Further, the CMP apparatus of this exemplary embodiment comprises platen 7 for receiving the pressure of head 3. Polishing pad 8 is attached to platen 7, against which the surface of semiconductor wafer 5 chucked by head 3 is pressed. This platen 7 is rotatable about the center thereof.

Dresser 9 is disposed on polishing pad 8 to remove clogging of polishing material from polishing pad 8. Polishing material nozzle 10 is present above and near the center of platen 7 to supply the polishing material.

Figure 5:
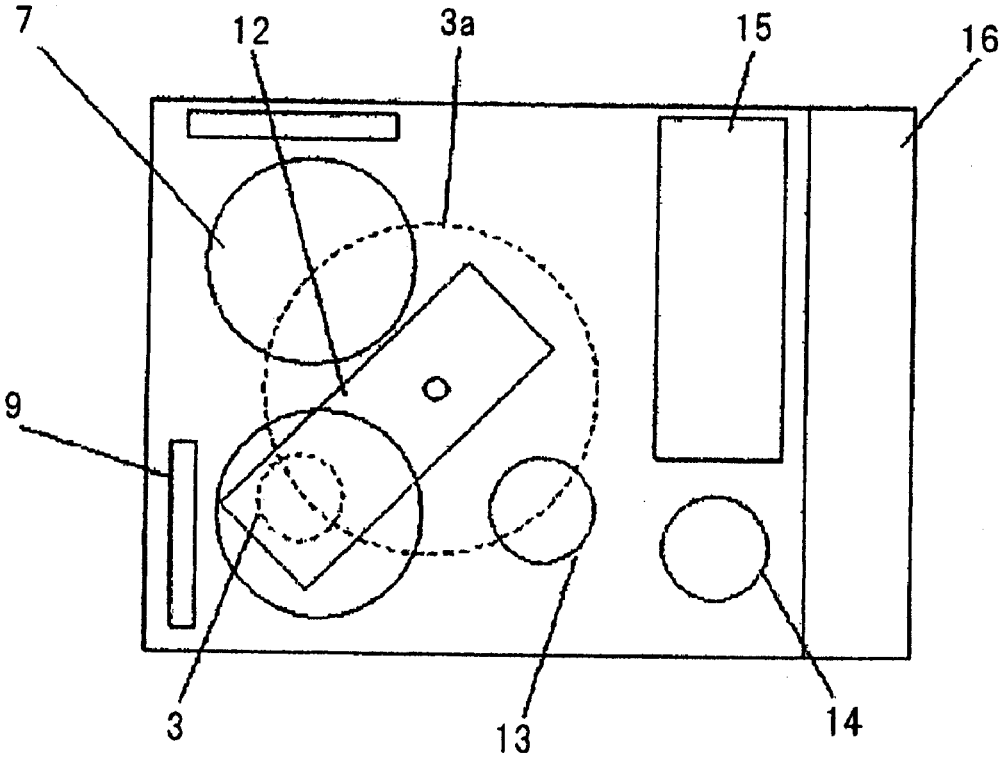
FIG. 5 is a top plan view showing the general configuration of a CMP polishing apparatus to which the present invention is applied.

FIG. 5 is a top plan view showing the general configuration of the CMP apparatus of this exemplary embodiment. As shown in this figure, the CMP apparatus of this exemplary embodiment comprises head 3 for holding and pressurizing a semiconductor wafer; cross 12 for applying a swinging motion to head 3; polishing pad 8 on the surface; platen 7 driven to rotate for polishing; and dresser 9 for adjusting the surface state of polishing pad 8. Further, the CMP apparatus comprises load/unload station 13 for loading and unloading semiconductor wafer 5 to/from head 3. Further, this apparatus comprises robot 14 for carrying semiconductor wafer 5; washing mechanism 15, and interface 16 for bringing semiconductor wafer 5, which is to be machined, into contact with the outside of the apparatus.

Next, a detailed description will be given of retainer ring 1 which is used in the first exemplary embodiment of the present invention.

As shown in FIG. 4, retainer ring 1 comprises a mixture of groove 2*a* formed across retainer ring 1 and concentric grooves 2*b*.

Groove 2*a* formed across retainer ring 1 is a groove for similar purposes to those intended by the inventions described in Patent Documents 1 and 2. Specifically, this groove is intended to promote the introduction of a polishing material, called slurry, onto the surface of semiconductor wafer 5, and facilitate dechucking of head 3 with respect to semiconductor wafer 5. For this reason, the groove has such a depth that does not disappear for the estimated use period, for example, 2 mm.

Concentric grooves 2*b* are grooves for purposes of changing the area of retainer ring 1 which comes into contact with polishing pad 8 as retainer ring 1 is increasingly worn in the wafer polishing operation. In this exemplary embodiment, each groove 2*b* has a different depth. For example, respective grooves 2*b* have depths of 0.1 mm, 0.2 mm, and 0.3 mm in order inwardly from the outer periphery of retainer ring 1. Each groove 2*b* has, for example, a width of 2 mm for the width of 20 mm of retainer ring 1. Respective grooves 2*b* are set to be eliminated in the order of the depth, i.e., 0.1 mm, 0.2 mm, and 0.3 mm as the polishing processing is repeated, such that the occupation ratio of grooves 2*b* becomes lower on the surface of retainer ring 1 in contact with polishing pad 8. In other words, as retainer ring 1 is increasingly worn, retainer ring 1 is in contact with polishing pad 8 over a larger area to reduce the contact pressure per unit area (pressure of retainer ring 1 against polishing pad 8).

Examples of materials for retainer ring 1 are PET, PPS, PEEK and the like.

Next, a description will be given of the operation of the CMP apparatus which has retainer ring 1 in the structure described above.

Referring to FIG. 5, semiconductor wafer 5 is first carried from interface 16 to load/unload station 13 by robot 14, and placed on load/unload station 13 in a face down orientation. Subsequently, head 3 chucks semiconductor wafer 5. A rotating motion of cross 12 causes head 3 to move onto polishing pad 8 attached to platen 7 (see head rotation trajectory 3*a*). Subsequently, while polishing material is supplied to polishing pad 8 on rotating platen 7 from polishing material nozzle 10, head 3 comes into contact with semiconductor wafer 5. In this event, a predetermined pressure is generally applied in the order of retainer ring 1 and membrane 6.

After the lapse of a predetermined time, semiconductor wafer 5 is dechucked from polishing pad 8 together with head 3, passes through load/unload station 13, is washed by washing mechanism 15, and is then carried to interface 16. This basic operation is repeated from one wafer to another.

As the basic operation is repeated, for example, after polishing 1000 wafers, retainer ring 1 is worn down by approximately 0.1 to 0.5 mm when it is made of a PPS resin, although the amount of wear depends on the material.

In the present invention, since groove 2*a*, which is formed across retainer ring 1, remains even though there has been wear on retainer ring 1, no adverse influences are exerted on the ability to supply the polishing material onto the surface of the wafer, or on the dechucking of head 3 from the wafer.

A plurality of concentric grooves 2*b* shown in FIG. 4 are designed to have depths of 0.1 mm, 0.2 mm, 0.3 mm, respectively, in order inwardly from the outer periphery of the ring, and each ring is eliminated in order inwardly from the outer peripheral side of the ring as wear increases on the retainer ring. As a result, the groove occupation ratio is reduced on the surface of retainer ring 1 in contact with polishing pad 8, resulting in an increase in contact area.

Figure 3:
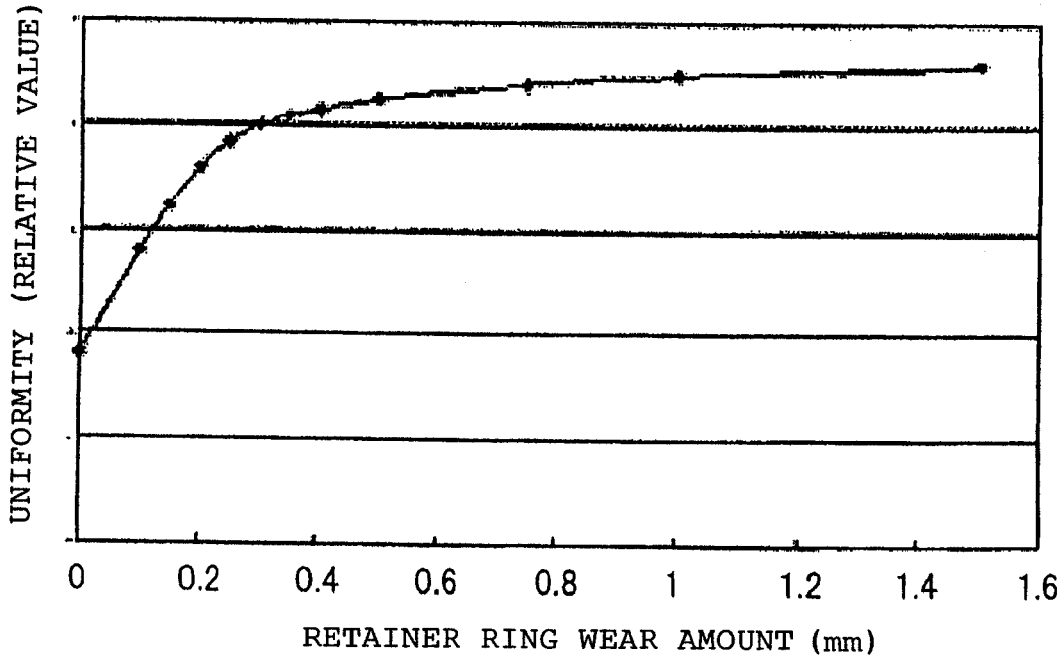
FIG. 3 is a graph showing the correlation between within-wafer uniformity of wafer polishing and a wear amount of the retainer ring when no adjustments are made to a pressure of the retainer ring no a polishing pad.

On the other hand, in regard to the shape of the surface of retainer ring 1 in contact with polishing pad 8, the wear advances particularly on the outermost side of the ring, causing a change in the shape of the contact surface. When the surface of retainer ring 1 in contact with polishing pad 8 initially has a flat shape, an increase in ring contact pressure due to the change in the shape of the outer peripheral side of the ring significantly contributes to a change in the uniformity of the amount of polishing of a semiconductor wafer, particularly in an initial stage where there is a small wear amount (FIG. 3). In contrast with this, in the present invention, such an increase in contact pressure is offset by the reduced groove occupation ratio, i.e., an increase in the contact area in accordance with the advance of wear, thus solving the problem of exacerbated uniformity. In particular, it is possible to limit a significant reduction in uniformity which becomes obvious in an initial stage after the start of use. Also, the present invention can stabilize the within-wafer uniformity without adjusting the set pressure on the polishing apparatus from one wear state to another, which affects the effective pressure of retainer ring 1, because the contact area automatically increases as more wear occurs on retainer ring 1.

In this regard, wear on retainer ring 1 occurs particularly from the outer peripheral side. For this reason, the depths of a plurality of concentric grooves 2*b* are set such that they can be eliminated in order inwardly from the outer peripheral side of the ring, such that the contact area can be increased as the wear advances, as described above.

As described above, according to this exemplary embodiment, it is possible to limit variations in polishing characteristics caused by the wear of the retainer ring which constitutes a problem in the CMP apparatus. As a result, higher uniformity is accomplished in planarization of inter-layer films and the like of semiconductor devices than conventional techniques, can achieve leading to an improved yield rate of products.

Figure 6:
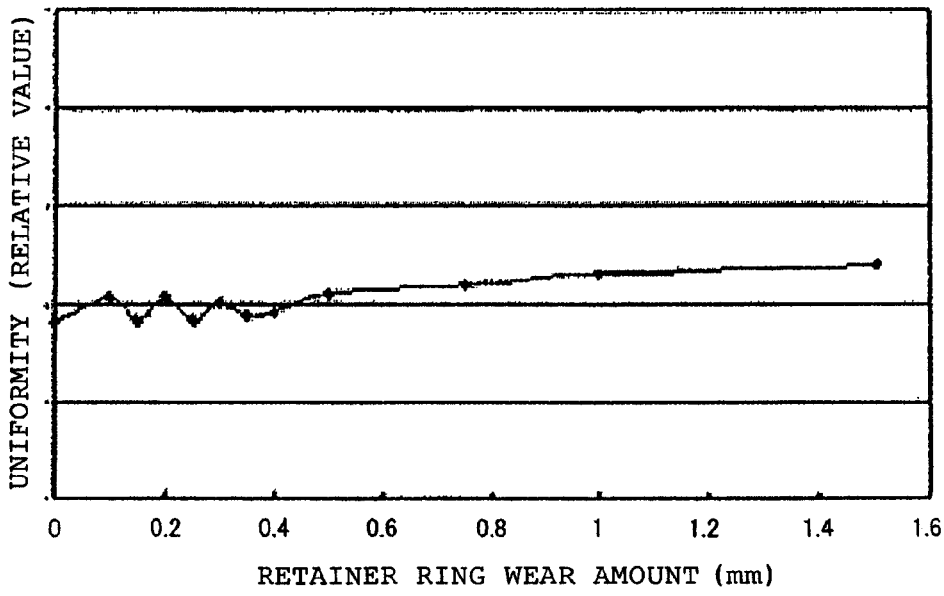
FIG. 6 is a graph showing the correlation of the within-wafer uniformity to the amount of retainer ring wear for demonstrating the effect of the present invention.

FIG. 6 shows the effect of the present invention in graphic representation. This graph is similar to FIG. 3, where the horizontal axis represents the amount of wear on the retainer ring, and the vertical axis represents the within-wafer uniformity (relative value) of the amount of wear in a semiconductor wafer. In comparison with the graph shown in FIG. 3, it can be seen that a change in within-wafer uniformity, which becomes obvious in an initial stage of retainer ring wear, is restrained, and that the within-wafer uniformity is stable for a long period from the start of use. On the other hand, in the graph of FIG. 3, the within-wafer uniformity exacerbates each time polishing is completed for 1000 wafers which produces, for example, a wear amount of 0.1 to 0.5 mm.

Second Exemplary Embodiment

Next, a description will be given of a second exemplary embodiment of the present invention, where the description will be given of only parts different from the CMP apparatus of the first exemplary embodiment.

Figure 7:
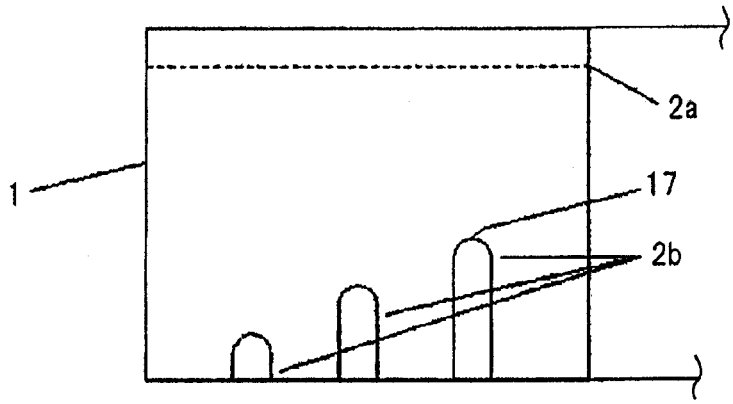
FIG. 7 is a cross-sectional view showing the main portion of a retainer ring used in a second exemplary embodiment of the present invention.

FIG. 7 is a cross-sectional view showing the main portion of a retainer ring used in the second exemplary embodiment of the present invention.

In this exemplary embodiment, the bottom surface of each groove 2*b* concentrically formed in a surface of retainer ring 1 in contact with polishing pad 8 is machined into a concavely curved shape.

For example, when the depth of each groove 2*b* is chosen to be 0.1 mm, 0.2 mm, or 0.3 mm in order inwardly from the outer periphery of retainer ring 1, the bottom surface of each groove 2*b* is formed with curved area 17 having radius R of approximately 0.05 mm.

When each groove 2*b* has a flat bottom surface, the groove is suddenly eliminated due to the advance of wear, and the shock is a concern at that time, but curved area 17 acts to damper the impact.

As another advantage, even for a slurry which is characteristically susceptible to fixation at perpendicularly machined areas of grooves, for example, such as cerium dioxide, curved area 17 can limit the fixation and limit scratches due to detachment of the coagulated slurry. This implementation is also effective in the machining of groove 2*a* for purposes of introducing a slurry.

Third Exemplary Embodiment

Next, a description will be given of a third exemplary embodiment of the present invention. Likewise, the description will be given herein only of parts different from the CMP apparatus of the first exemplary embodiment.

Figure 8:
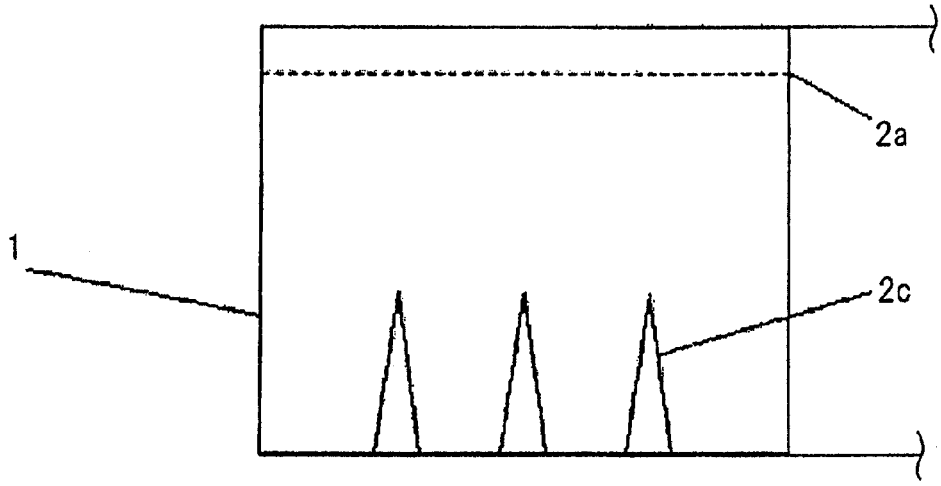
FIG. 8 is a cross-sectional view showing the main portion of a retainer ring used in a third exemplary embodiment of the present invention.

FIG. 8 is a cross-sectional view showing a main portion of a retainer ring used in the third exemplary embodiment of the present invention.

In this exemplary embodiment, each of the grooves concentrically provided in the surface of retainer ring 1 in contact with polishing pad 8 has the same depth and is tapered toward the bottom of the groove. Specifically, each of the concentric grooves is a tapered groove 2*c* as shown in FIG. 8, and differs from the first exemplary embodiment in that there are grooves 2*b* which differ from each other in regard to depth.

The bottom surface of grooves 2*c* may be machined into a concavely curved surface as in the second exemplary embodiment.

Taking such a form of grooves, the correlation of a groove occupation ratio to a contact area when the retainer ring is worn is more readily matched with a change in contact pressure associated with the increasingly worn retainer ring.

It should be noted that the foregoing technical idea can be combined with a change in depth of each groove, in which case the controllability of the retainer ring contact pressure is further improved.

Fourth Exemplary Embodiment

Next, a description will be given of a fourth exemplary embodiment. Likewise, description will be given herein only of parts different from the CMP apparatus of the first exemplary embodiment.

Figure 9:
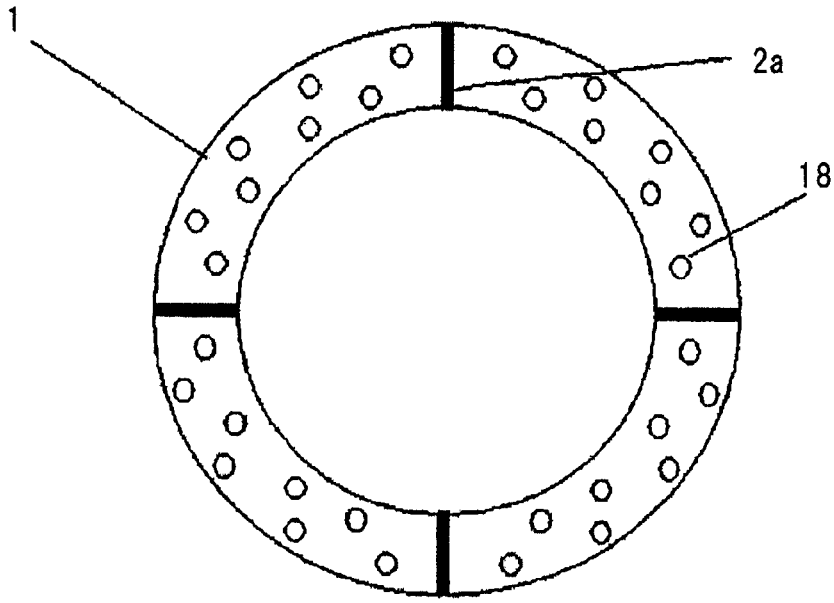
FIG. 9 is a plan view seen from a surface of a retainer ring which comes into contact with a polishing pad, used in a fourth exemplary embodiment of the present invention.

FIG. 9 is a plan view seen from the surface of a retainer ring used in the fourth exemplary embodiment of the present invention in contact with a polishing pad.

In this exemplary embodiment, on the surface of retainer ring 1 in contact with polishing pad 8, groove 2*a* formed across retainer ring 1 co-exists with a plurality of holes machined thereinto at a plurality of depths.

Groove 2*a* formed across retainer ring 1 is a groove for a similar purpose to that of the inventions described in Patent Documents 1 and 2. Specifically, this groove is intended to promote the introduction of a slurry, onto the surface of semiconductor wafer 5, and to facilitate dechucking of head 3 with respect to semiconductor wafer 5. For this reason, the groove has such a depth that does not disappear for the estimated use period, for example, 2 mm.

On the other hand, a plurality of machined holes 18 are grooves for the purpose of changing the contact area of retainer ring 1 to polishing pad 8 in accordance with wear on retainer ring 1 during a wafer polishing operation. For this purpose, each machined hole 18 has a different depth. For example, the plurality of machined holes 18 are provided by boring to have two different depths, 0.1 mm and 0.2 mm.

Like examples such as grooves 2*b*, 2*c* in the first, second, and third exemplary embodiments, the contact area can be adjusted because the occupation ratio of machined holes 18 is reduced as wear on the retainer ring increases.

In addition, the bottom of hole 18 may be machined into concavely curved shape. Alternatively, hole 18 may be tapered such that the hole has a smaller width toward the bottom. Such a shape produces similar effects to those of the second and third exemplary embodiments.

Fifth Exemplary Embodiment

Next, a description will be given of a fifth exemplary embodiment of the present invention. Likewise, description will be given herein only of parts different from the CMP apparatus of the first exemplary embodiment.

Figure 10:
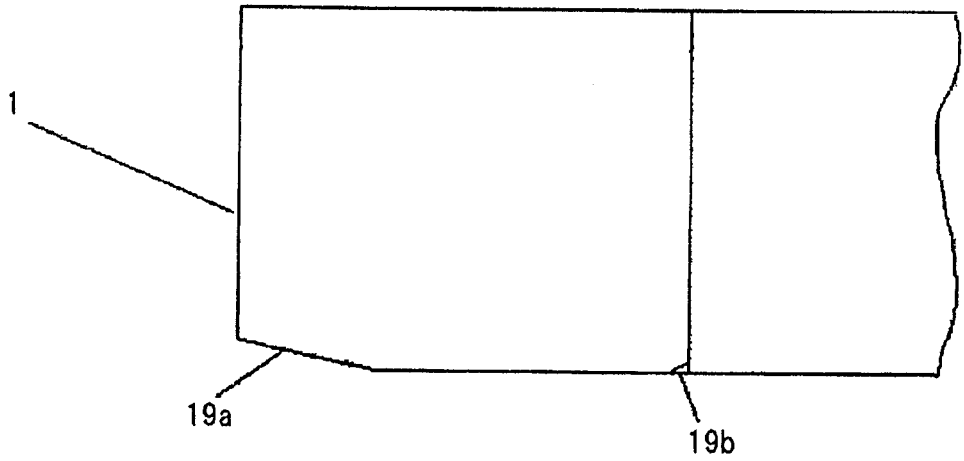
FIG. 10 is a cross-sectional view showing the main portion of a retainer ring used in a fifth exemplary embodiment of the present invention.

FIG. 10 is a cross-sectional view showing the main portion of a retainer ring used in the fifth exemplary embodiment of the present invention.

In this exemplary embodiment, instead of concentric grooves 2*b* in the first exemplary embodiment, taper 19*a* is formed on the outer peripheral edge of retainer ring 1 in contact with a polishing pad. While tapering (chamfering) is used for machining the outer peripheral edge, curving can also be employed.

Further, taper 19*b* may also be formed on the inner peripheral edge of retainer ring 1 in contact with the polishing pad. However, this taper 19*b* must be formed such that semiconductor wafer 5 within retainer ring 1 does not slip out to the outside during a polishing operation. For this reason, taper

19*b* may be formed around the entire inner periphery of the retainer ring provided that its height is limited to such a height that prevents the slip-out, for example, a maximum taper height of 0.4 mm. Alternatively, taper 19*b* can be partially formed on the inner peripheral edge of the retainer ring. In this event, the taper is not limited in height. In addition, for machining the inner peripheral edge, curving may be employed instead of tapering.

As described above, in this exemplary embodiment, the outer peripheral edge (rectangular section) of retainer ring 1 in contact with the polishing pad, which suffers from a change in shape due to advancing wear particularly in the initial stage of polishing, is previously machined into a tapered shape or a curved shape, such that such a change in shape on the outer peripheral edge of the ring does not occur in the initial stage of polishing. In this way, the problem of a large change in within-wafer uniformity in the initial stage from the start of use is solved.

With the foregoing configuration, the ring width on the polishing pad contact surface side gradually extends as wear advances from the start of use. As a result, the effective pressure (contact pressure with polishing pad 8) of retainer ring 1 can be automatically reduced in accordance with the amount of wear in geometric progression. From the foregoing, the uniformity of the amount of polishing can be continued and stabilized.

In the tapering or curving on the outer peripheral edge and inner peripheral edge of the retainer ring, the shape of the wear on the retainer ring actually used in the CMP apparatus may be analyzed, and the shape of the machined area may be approximated to that shape. Also, the uniformity of the amount of polishing can be adjusted by changing the taper height and the taper angle of a tapered edge, the curvature of a curved area, and the like with respect to the outer peripheral edge of the retainer ring.

Sixth Exemplary Embodiment

Next, a description will be given of a sixth exemplary embodiment of the present invention. Likewise, description will be given herein only of parts different from the CMP apparatus of the first exemplary embodiment.

Figure 11:
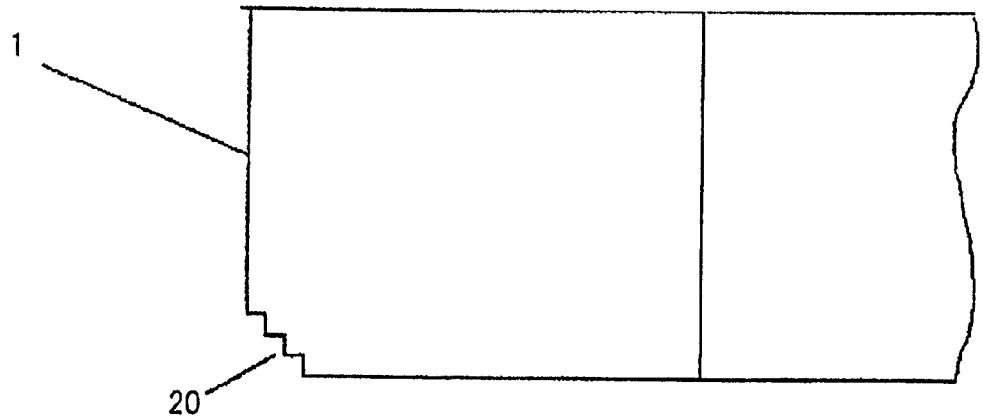
FIG. 11 is a cross-sectional view showing the main portion of a retainer ring used in a sixth exemplary embodiment of the present invention.

FIG. 11 is a cross-sectional view showing the main portion of a retainer ring used in the sixth exemplary embodiment of the present invention.

In this exemplary embodiment, instead of concentric grooves 2*b* in the first exemplary embodiment, step area 20 is formed on the outer peripheral edge of the surface of retainer ring 1 in contact with a polishing pad in a multi-step configuration.

Specifically, in this exemplary embodiment, the outer peripheral edge (rectangular corner) of the surface of retainer ring 1 in contact with the polishing pad, which changes in shape due to wear that advances particularly in an initial stage of wear, is modified into a shape comprising rectangle corners repeated in steps as shown in FIG. 11, for the purpose of eliminating a change in shape on the outer peripheral side of the ring in such an initial stage of wear. In this way, the problem of a large change in within-wafer uniformity at an initial stage from the start of use is solved. A larger number of steps in step area 20 is more preferable.

According to the configuration described above, the ring width on the polishing pad contact surface side gradually extends as the wear advances from the start of use. As a result, the effective pressure (contact pressure toward polishing pad 8) of retainer ring 1 can be automatically reduced in accordance with the amount of wear in geometric progression. From the foregoing, the within-wafer uniformity can be stabilized in the polishing of a wafer.

The uniformity of the amount of polishing can be adjusted by a combination of the width of steps, the number of steps, and the height in step area 20.

Seventh Exemplary Embodiment

Next, a description will be given of a seventh exemplary embodiment of the present invention. Likewise, description will be given herein only of parts different from the CMP apparatus of the first exemplary embodiment.

Figure 12:
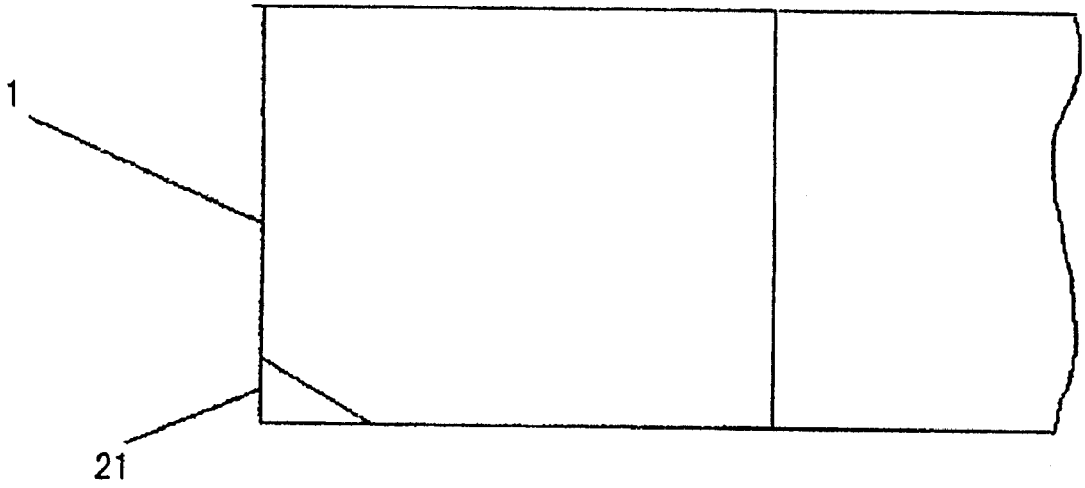
FIG. 12 is a cross-sectional view showing the main portion of a retainer ring used in a seventh exemplary embodiment of the present invention.

FIG. 12 is a cross-sectional view showing the main portion of a retainer ring used in the seventh exemplary embodiment of the present invention.

In this exemplary embodiment, instead of concentric grooves 2*b* in the first exemplary embodiment, an outer peripheral area (rectangular corner) of the surface of retainer ring 1 in contact with a polishing pad is formed of a material which differs in physical properties from the remaining area.

Specifically, in this exemplary embodiment, the outer peripheral edge (rectangular corner) of the surface of retainer ring 1 in contact with the polishing pad, which changes in shape due to wear that advances particularly in an initial stage of wear, is changed to low hardness material 21 which is relatively low in hardness as compared with the remaining area, for the purpose of rapidly reducing a local change in contact pressure due to such a change in shape. Further, the bonding interface of the area of this low-hardness material 21 with the remaining area is slanted as shown in FIG. 12. In this way, changes in within-wafer uniformity, which have become obvious in an initial stage from the start of use are limited.

According to the foregoing configuration, the area of low-hardness material 21 on the outer peripheral edge of retainer ring 1 is worn earlier than the remaining area from the start of use, so that partial wear accelerates on the outer peripheral side of the ring. As a result, the bonding interface of low-hardness material 21 immediately begins to be exposed. Then, the occupation ratio of low-hardness material 21 becomes gradually lower in accordance with wear of the entire surface in contact with the polishing pad, whereas, on the contrary, the ring shape of the remaining area other than low-hardness material 21 gradually expands on the polishing pad contact surface side. From the foregoing, the effective pressure (contact pressure toward polishing pad 8) of retainer ring 1 can be automatically reduced in accordance with the amount of wear in geometric progression. Accordingly, the within-wafer uniformity in wafer polishing can be stabilized from the start of use.

Alternatively, a resin exhibiting a relatively high wearing rate may be applied instead of low-hardness material 21.

As described above by using a variety of exemplary embodiments, it is contemplated that the surface of the retainer ring in contact with the polishing pad is formed having a plurality of grooves or holes which differ in depth from one another, or is formed with a tapered or curved groove or hole.

When such a structure is employed, a plurality of grooves or holes which differ in depth eliminated in steps, or the tapered or curved groove or hole is reduced in size in steps in accordance with wear of the retainer ring. Specifically, as wear on the retainer ring increases, the contact surface increases to act to reduce the contact pressure per unit area. It is therefore possible to stabilize the uniformity of the amount of polishing continuously from an initial stage of wear.

It is also contemplated that the outer peripheral area of the surface of the retainer ring in contact with the polishing pad is formed by a tapered or convexly curved surface or is formed by multiple steps.

When such a structure is employed, the width of the surface of the retainer ring in contact with the polishing pad expands step by step as wear increases on the retainer ring while wafers are polished. In this way, changes in the uniformity of the amount of polishing can be limited, like the action of the aforementioned structure.

It is also contemplated that the outer peripheral area of the surface of the retainer ring in contact with the polishing pad is made of a material which differs in physical properties from the remaining area.

When such a structure is employed, the shape of the surface of the retainer ring in contact with the polishing pad expands step by step as wear increases on the retainer ring while wafers are polished. In this way, changes in the uniformity of the amount of polishing can be restrained, like the action of the aforementioned structure.

As described above, according to the present invention, it is possible to limit variations in polishing characteristics caused the wear that occurs on the retainer ring, which constitutes a problem in the wafer polishing apparatus, such that the flatness of semiconductor devices is automatically prevented from reducing the yield rate of products.

Also, the aspects of the present invention can be applied not only to the step of planarizing inter-layer films such as oxide films in a method of manufacturing a semiconductor device formed on a semiconductor wafer but also to the other steps. For example, in a process of forming a metal plug or a metal wire (Damascene), it goes without saying that the present invention can also be applied to a metal film polishing step and the like when unnecessary portions of an embedded film are removed, and is not limited to items to be polished.

While preferred exemplary embodiments of the present invention have been described using specific terms, such description is for illustrative purposes only, and it is to be understood that changes and variations may be made without departing from the spirit or scope of the following claims.

What is claimed is:

1. A semiconductor device manufacturing apparatus comprising:

a head for holding a semiconductor wafer, a retainer ring for surrounding the outer periphery of the semiconductor wafer held by said head, and a polishing pad for polishing a polished surface of the semiconductor wafer, the semiconductor device manufacturing apparatus pressing the polished surface of the semiconductor wafer against said polishing pad together with said retainer ring to polish the semiconductor wafer, wherein:

concentric grooves which differ in depth or a plurality of holes which differ in depth are formed in a surface of said retainer ring that is in contact with said polishing pad.

2. A semiconductor device manufacturing method using a polishing apparatus comprising a head for holding a semiconductor wafer, a retainer ring for surrounding the outer periphery of the semiconductor wafer held by said head, and a polishing pad for polishing a polished surface of the semiconductor wafer, wherein concentric grooves which differ in depth or a plurality of holes which differ in depth are formed in a surface of said retainer ring that is in contact with said polishing pad, the semiconductor device manufacturing apparatus pressing the polished surface of the semiconductor wafer onto said polishing pad together with said retainer ring to polish the semiconductor wafer, said method comprising:

adjusting an effective pressure of said retainer ring by eliminating, step by step, the plurality of said grooves or holes in accordance with wear that occurs on said retainer ring, when polishing the semiconductor wafer.

3. The semiconductor device manufacturing apparatus according to claim 1, wherein said concentric grooves which differ in depth are formed such that the depth of each successive groove becomes shallower toward an outer peripheral edge portion of said retainer ring.

4. The semiconductor device manufacturing apparatus according to claim 1, wherein the bottom of said grooves and holes have a curved surface.

5. A semiconductor device manufacturing apparatus comprising:

a head for holding a semiconductor wafer, a retainer ring for surrounding the outer periphery of the semiconductor wafer held by said head, and a polishing pad for polishing a polished surface of the semiconductor wafer, the semiconductor device manufacturing apparatus pressing the polished surface of the semiconductor wafer against said polishing pad together with said retainer ring to polish the semiconductor wafer, wherein concentric grooves each having a tapered surface or a plurality of holes each having a tapered surface are formed in a surface of said retainer ring that is in contact with said polishing pad, and wherein each of said concentric grooves having the tapered surface differ in depth, and the concentric grooves are formed such that the depth of each successive groove becomes shallower toward an outer peripheral edge portion of said retainer ring.

6. A semiconductor device manufacturing apparatus comprising:

a head for holding a semiconductor wafer, a retainer ring for surrounding the outer periphery of the semiconductor wafer held by said head, and a polishing pad for polishing a polished surface of the semiconductor wafer, the semiconductor device manufacturing apparatus pressing the polished surface of the semiconductor wafer against said polishing pad together with said retainer ring to polish the semiconductor wafer, wherein concentric grooves each having a tapered surface or a plurality of holes each having a tapered surface are formed in a surface of said retainer ring that is in contact with said polishing pad, and wherein the bottom of said grooves and holes have a curved surface.

* * * * *